US008336728B2

(12) United States Patent
Forrest et al.

(10) Patent No.: US 8,336,728 B2
(45) Date of Patent: Dec. 25, 2012

(54) VENTABLE RESEALING CAN END CLOSURE

(75) Inventors: Randall G. Forrest, Park Ridge, IL (US); Timothy L. Turner, Port Charlotte, FL (US)

(73) Assignee: Rexam Beverage Can Company, Chicago, IL (US)

( * ) Notice: Subject to any disclaimer, the term of this patent is extended or adjusted under 35 U.S.C. 154(b) by 1283 days.

(21) Appl. No.: 12/106,877

(22) Filed: Apr. 21, 2008

(65) Prior Publication Data

US 2009/0261101 A1 Oct. 22, 2009

(51) Int. Cl.
*B65D 51/16* (2006.01)
*B65D 41/06* (2006.01)

(52) U.S. Cl. ..... 220/303; 220/304; 220/366.1; 220/906; 220/254.8

(58) Field of Classification Search ..... 220/254.8, 220/259.4, 293, 298, 300, 301, 303, 304, 220/269, 906, 785, 366.1; 215/305, 330
See application file for complete search history.

(56) References Cited

U.S. PATENT DOCUMENTS

| | | | | | |
|---|---|---|---|---|---|
| 253,075 | A | * | 1/1882 | Lyon | 220/300 |
| 634,742 | A | | 10/1899 | Bayless | |
| 684,799 | A | | 10/1901 | Devoe | |
| 1,598,098 | A | * | 8/1926 | Muhlbach | 220/300 |
| 1,598,870 | A | | 9/1926 | Merry | |
| 1,746,926 | A | * | 2/1930 | Boyle, Jr. | 220/300 |
| 2,241,793 | A | | 5/1941 | Steven | |
| 2,337,616 | A | | 12/1943 | McManus et al. | |
| 2,363,693 | A | | 11/1944 | Robinson | |
| 2,661,863 | A | * | 12/1953 | Howe | 220/301 |
| 2,908,417 | A | | 10/1959 | Conner et al. | |
| 3,021,976 | A | | 2/1962 | Tracy | |
| 3,219,004 | A | | 11/1965 | Wilton | |
| 3,477,608 | A | | 11/1969 | Fraze | |
| 3,672,547 | A | | 6/1972 | Kozlowski | |
| 3,704,677 | A | | 12/1972 | Moller | |
| 3,844,443 | A | | 10/1974 | Cudzik | |
| 3,868,038 | A | | 2/1975 | Hadley | |
| 4,043,474 | A | | 8/1977 | McCord | |

(Continued)

FOREIGN PATENT DOCUMENTS

GB 2180521 A 4/1987

OTHER PUBLICATIONS

Reexam Beverage Can Company, PCT International Search Report from co-pending PCT Application No. PCT/US2009/041242.

*Primary Examiner* — Anthony Stashick
*Assistant Examiner* — James N Smalley
(74) *Attorney, Agent, or Firm* — Ungaretti & Harris LLP

(57) ABSTRACT

A can end for a container has a metallic main portion and a polymeric separable cap. The metallic main portion is positioned about a longitudinal axis and has a curl defining a radially outer perimeter of the can end. A center panel is joined to the curl. A dispensing aperture is in the center panel, and a plurality of projections extend radially inwardly into the dispensing aperture. The polymeric separable cap is in the dispensing aperture and has a plurality of angled channels. The channels have an entry portion opposite a terminal end and a vent region therebetween.

20 Claims, 5 Drawing Sheets

U.S. PATENT DOCUMENTS

| | | | | | |
|---|---|---|---|---|---|
| 4,202,462 | A | | 5/1980 | Imber | |
| 4,632,271 | A | * | 12/1986 | Taylor et al. | 220/258.2 |
| 5,249,703 | A | | 10/1993 | Karp | |
| 5,322,177 | A | | 6/1994 | Coggings | |
| 5,443,175 | A | | 8/1995 | Kelly et al. | |
| 5,688,544 | A | | 11/1997 | Bolton et al. | |
| 5,704,510 | A | | 1/1998 | Feltman, III et al. | |
| 6,015,054 | A | * | 1/2000 | King et al. | 215/252 |
| 6,193,096 | B1 | | 2/2001 | Raoult | |
| 6,959,830 | B1 | | 11/2005 | Kanou et al. | |
| 7,051,896 | B2 | | 5/2006 | Steadman | |
| 7,171,840 | B2 | | 2/2007 | Kanou et al. | |
| 2004/0159665 | A1 | | 8/2004 | Morrissey et al. | |
| 2005/0029264 | A1 | | 2/2005 | Werth | |
| 2006/0011633 | A1 | | 1/2006 | Cook et al. | |
| 2007/0062952 | A1 | | 3/2007 | Kobayashi et al. | |

* cited by examiner

VENTABLE RESEALING CAN END CLOSURE

CROSS-REFERENCE TO RELATED APPLICATIONS

N/A

FEDERALLY SPONSORED RESEARCH OR DEVELOPMENT

N/A

TECHNICAL FIELD

The invention relates to beverage containers. More particularly, the present invention is related to a can end closure which is both ventable for initial release of pressure within a beverage container and resealable to preserve the contents for later ingestion.

BACKGROUND OF THE INVENTION

Common end closures for beer and beverage containers have a central panel that has a frangible panel (sometimes called a "tear panel," "opening panel," or "pour panel") defined by a score formed on the outer surface, the "consumer side," of the end closure. Popular "ecology" can ends are designed to provide a way of opening the end by fracturing the scored metal of the panel, while not allowing separation of any parts of the end. For example, the most common such beverage container end has a tear panel that is retained to the end by a non-scored hinge region joining the tear panel to the remainder of the end, with a rivet to attach a leverage tab provided for opening the tear panel. This type of container end, typically called a "stay-on-tab" ("SOT") end has a tear panel that is defined by an incomplete circular-shaped score, with the non-scored segment serving as the retaining fragment of metal at the hinge-line of the displacement of the tear panel.

The container is typically a drawn and ironed metal can, usually constructed from a thin plate of aluminum. End closures for such containers are also typically constructed from a cut-edge of thin plate of aluminum or steel, formed into a blank end, and manufactured into a finished end by a process often referred to as end conversion. These ends are formed in the process of first forming a cut-edge of thin metal, forming a blank end from the cut-edge, and converting the blank into an end closure which may be seamed onto a container. Although not presently a popular alternative, such containers and/or ends may be constructed of plastic material, with similar construction of non-detachable parts provided for openability.

These containers are typically filled with carbonated beverages that create a substantial pressure within the container. Upon opening the container, this pressure must be quickly and safely vented. For this reason can ends are constructed for venting or releasing the internal pressure of the container during the initial opening of the container.

When the tab is lifted, an upward force is placed on a rivet that attaches the tab to the end, and a downward force is placed on the tear panel. This causes an initial opening of the tear panel beneath the nose of the tab in an area referred to as the vent region of the can end. Further lifting of the tab causes the tear panel to separate progressively along the score.

Upon fracturing of the vent region, rapid disassociation of the tear panel from the end panel, or more simply, the "missiling" of the tear panel may occur. For this reason, some manufacturers place anti-missile features on the consumer side of the can end.

More recently, manufacturers have attempted to provide resealable beverage containers wherein the resealable closure cap seals a dispensing aperture rather than the SOT design described above. To date, these efforts have not been widely accepted as commercially viable. One reason for the lack of acceptance is the difficulty presented by the substantial pressure within the container that must be quickly and safely vented.

The present invention is provided to solve the problems discussed above and other problems, and to provide advantages and aspects not provided by prior resealable can end closures of this type. A full discussion of the features and advantages of the present invention is deferred to the following detailed description, which proceeds with reference to the accompanying drawings.

SUMMARY OF THE INVENTION

A first aspect of the present invention is directed to a can end for a container. The can end comprises a metallic main portion and a polymeric separable cap. The metallic main portion is positioned about a longitudinal axis and includes a curl defining a radially outer perimeter of the can end, a center panel joined to the curl, a dispensing aperture in the center panel, and a plurality of projections extending radially inwardly into the dispensing aperture. The polymeric separable cap is within the dispensing aperture and includes a plurality of angled channels. The channels have an entry portion opposite a terminal end and a vent region therebetween. The vent region may be located at a height below the terminal end and at least a segment of the entry portion may be located at a height above the vent region At least one of the angled channels may further comprise a lowermost portion defining a vent stop in the vent region and/or a pair of elevated portions on opposite ends of the vent stop. The vent stop may have a recessed portion in the channel and a lip creating an angle with the recessed portion less than 90 degrees and greater than 0 degrees and/or a portion located at a height below the terminal end wherein at least a segment of the entry portion is located at a height above the vent region.

This first aspect of the present invention may further comprise a displaceable handle having a lift end liftable from a stowage position to an opening position wherein an angle between said lift end and the longitudinal axis is decreased. The handle may have an elastic characteristic wherein the handle can be lifted from and returned to the stowage position multiple times while remaining joined to a portion of the can end. The opposing end of the displaceable handle may be hingedly connected to the separable cap and may have an outwardly extending tab which engages a portion a portion of the separable cap in the opening position to retain the displaceable handle in the opening position. The separable cap may have a recess on a surface for receiving the tab therein when in the opening position which retains the tab therein to maintain the displaceable handle in the opening position.

The first aspect of the invention may further comprise a flange. The flange is located on the separable cap and extends radially outwardly beyond a perimeter of the aperture. The cap may have an arcuate lower wall extending downwardly relative to a lower surface of the separable cap. The arcuate lower wall is located radially inwardly from the flange and at least partially located within the aperture. A bottom surface of the flange may have an annular sealing ring positioned about the longitudinal axis. The annular sealing ring is in engagement with the center panel to form a pressure resistant seal with the center panel. The center panel may have a curl defining a peripheral edge of the aperture in engagement with the annular sealing ring. The annular sealing ring may comprise an annular recess in the bottom surface of the flange, and a seal liner may be within the annular recess of a different material than the separable cap. The plurality of channels may be located on the arcuate wall of the separable cap.

A second aspect of the present invention is directed to a ventable sealing arrangement for safely releasing pressure within a beverage container under pressure upon opening of the beverage container. The ventable sealing arrangement comprises an aperture, a plurality of circumferentially spaced projections within the aperture, and a plurality of angled channels within the aperture. The aperture is positioned about a longitudinal axis within which a resealable cap is located in a sealed condition. The plurality of angled channels are associated with each of the plurality of spaced projections wherein the spaced projections are located within corresponding angled channels. At least one of the plurality of angled channels has a vent stop. The vent stop is characterized by a recessed portion in the channel and a lip creating an angle with the recessed portion less than 90 degrees and greater than 0 degrees. The angled channels may extend downwardly to the vent stop and the lip may angle upwardly from the vent stop to an entry end of each of the angled channels. At least one angled channel may have an entry portion opposite a terminal portion. The terminal portion is elevated above the entry portion.

This second aspect of the invention may further comprise a lid and a separable cap. The lid may have a main portion having a curl defining a radially outer perimeter of the lid, a center panel joined to the curl. The aperture is located on the center panel as are the plurality of circumferentially spaced projections extending radially inwardly into the aperture. The separable cap is in the dispensing aperture. The plurality of angled channels are located on a downwardly extending wall of the separable cap and have an entry portion and a terminal portion. The vent stop is located adjacent the entry portion. Relative rotational movement of the separable cap within the aperture results in each of the plurality of spaced projections approaching the entry portion of each of the channels and into an associated vent stop recessed within the associated channel.

Alternatively, this aspect may further comprise a can lid and a separable cap. The can lid has a curl defining a radially outer perimeter of the can lid, a center panel joined to the curl, a dispensing aperture in the center panel. The plurality of projections extend radially inwardly into the dispensing aperture. The separable cap is in the dispensing aperture and comprises the plurality of angled channels. The channels have an entry portion opposite a terminal end and a vent region including the vent stop therebetween. At least a segment of the entry portion is located at a height above the vent region.

A third aspect of the present invention is directed to a can end for a container. The can end comprises a main portion and a separable cap. The main portion is positioned about a longitudinal axis and has a curl defining a radially outer perimeter of the can end, a center panel joined to the curl, a dispensing aperture in the center panel, and a plurality of projections extending radially inwardly into the dispensing aperture. The separable cap is in the dispensing aperture and has a plurality of angled channels. The channels have an entry portion opposite a terminal end and a vent region therebetween. The vent region has a downwardly sloped portion of the angled channels angled less than 90 degrees to a vent stop located at a lowermost portion of the downwardly sloped portion of the angled channels. The angled channels further have an upwardly angled portion between the vent stop and the entry portion.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
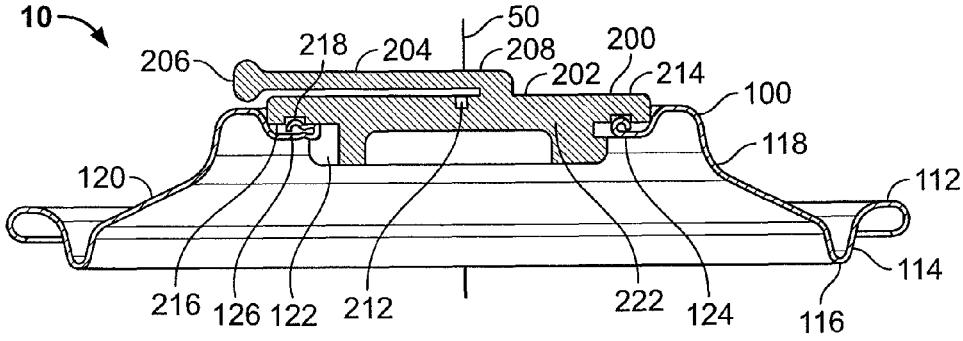
FIG. 1 is a cross-sectional view of a can end of the present invention.
Figure 2:
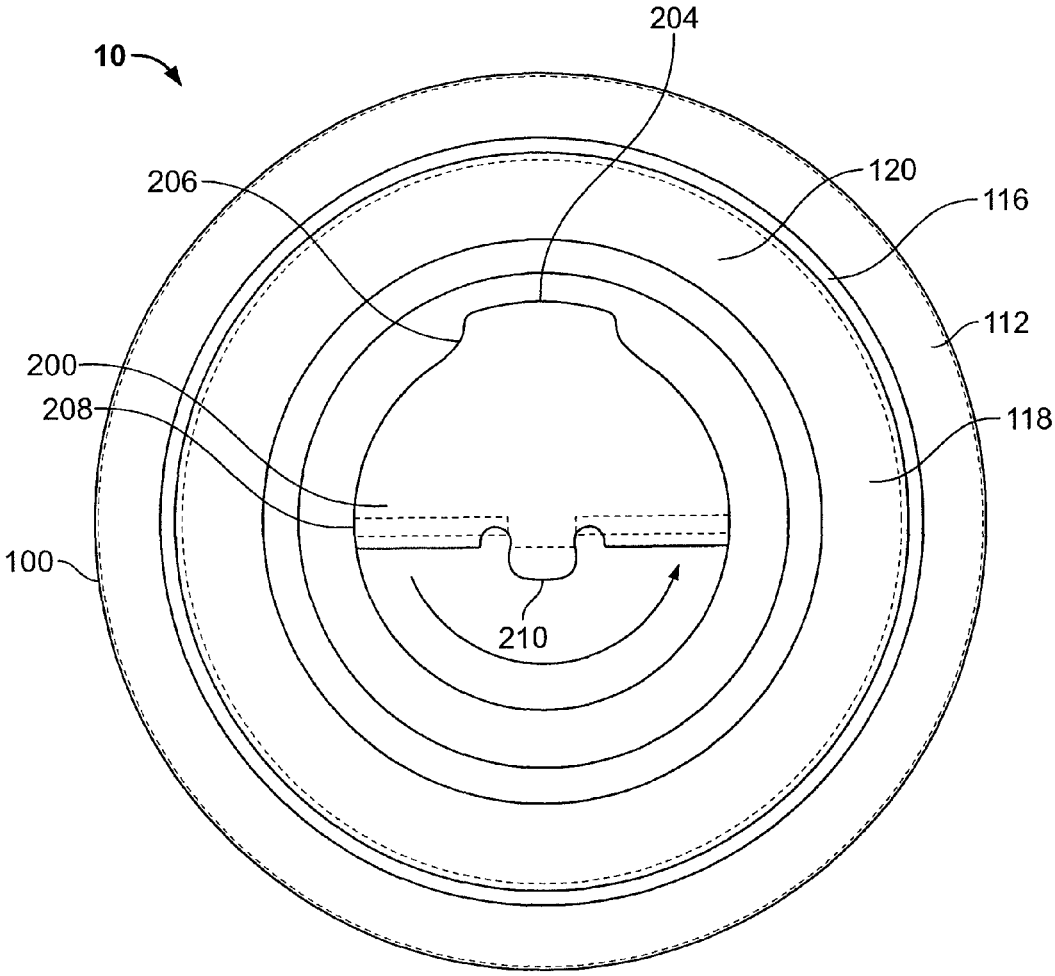
FIG. 2 is a top view of the can end of FIG. 1.
Figure 3:
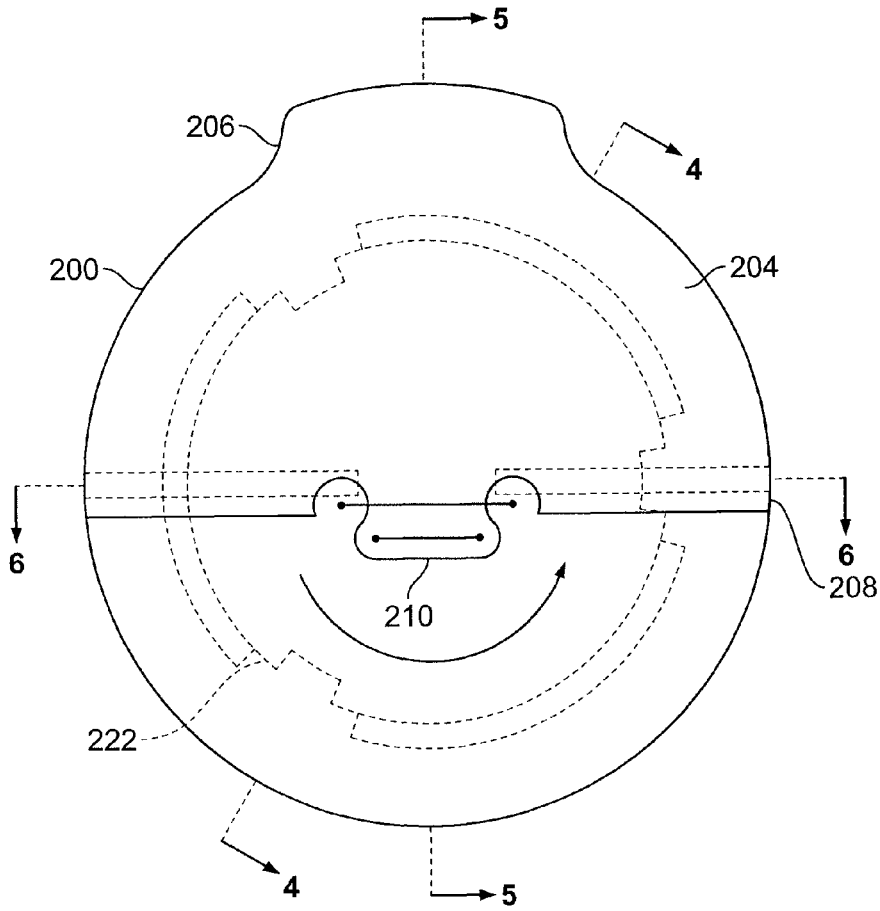
FIG. 3 is a top view of a resealable closure cap.
Figure 4:
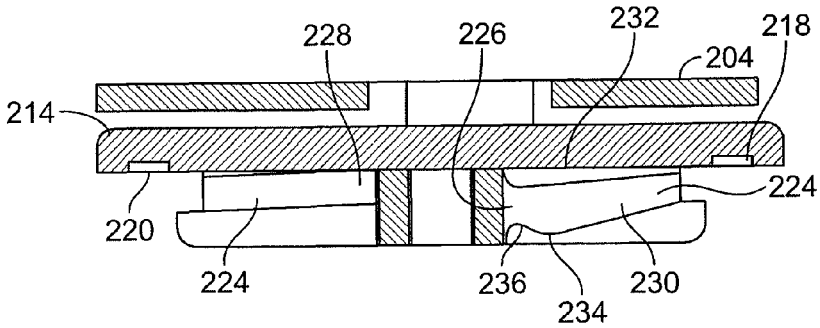
FIG. 4 is a cross-sectional view taken along 4-4 of FIG. 3.
Figure 5:
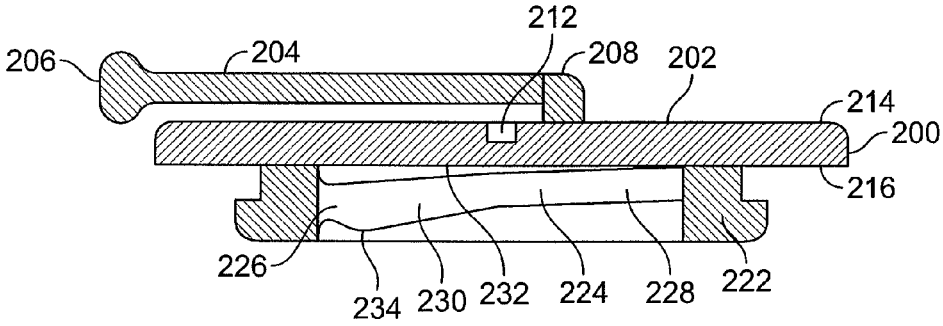
FIG. 5 is a cross-sectional view taken along 5-5 of FIG. 3.
Figure 6:
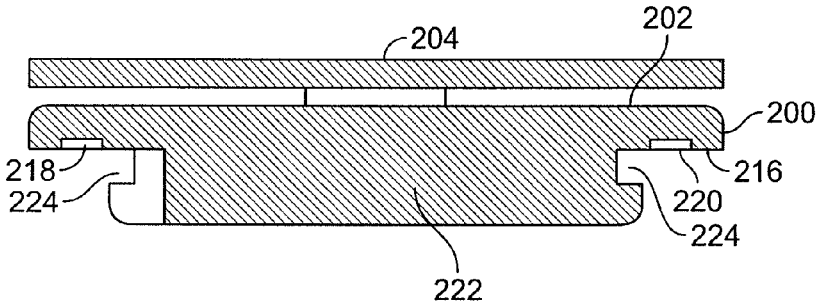
FIG. 6 is a cross-sectional view taken along 6-6 of FIG. 3.
Figure 7:
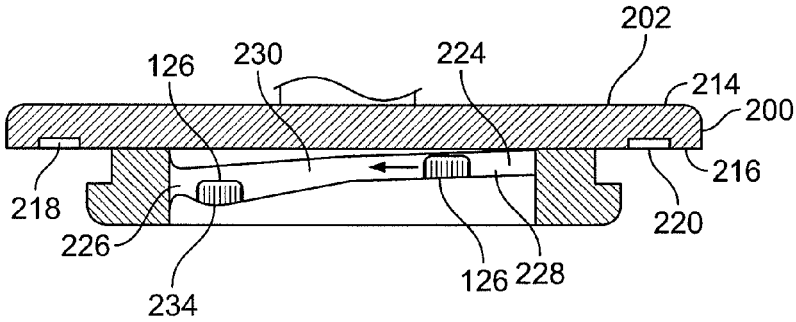
FIG. 7 is a cross-sectional view of a closure cap showing lug traverse within a channel on the closure cap.
Figure 8:
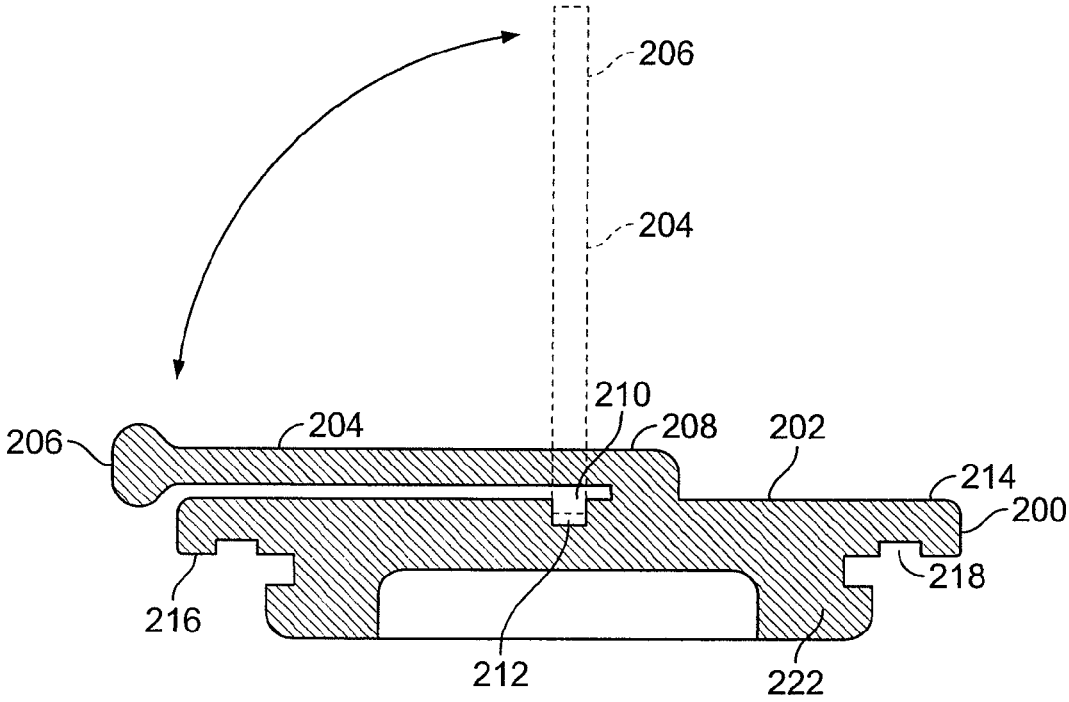
FIG. 8 is a cross-sectional view of a closure cap showing a handle going from a stowage position to an opening position.
Figure 9:
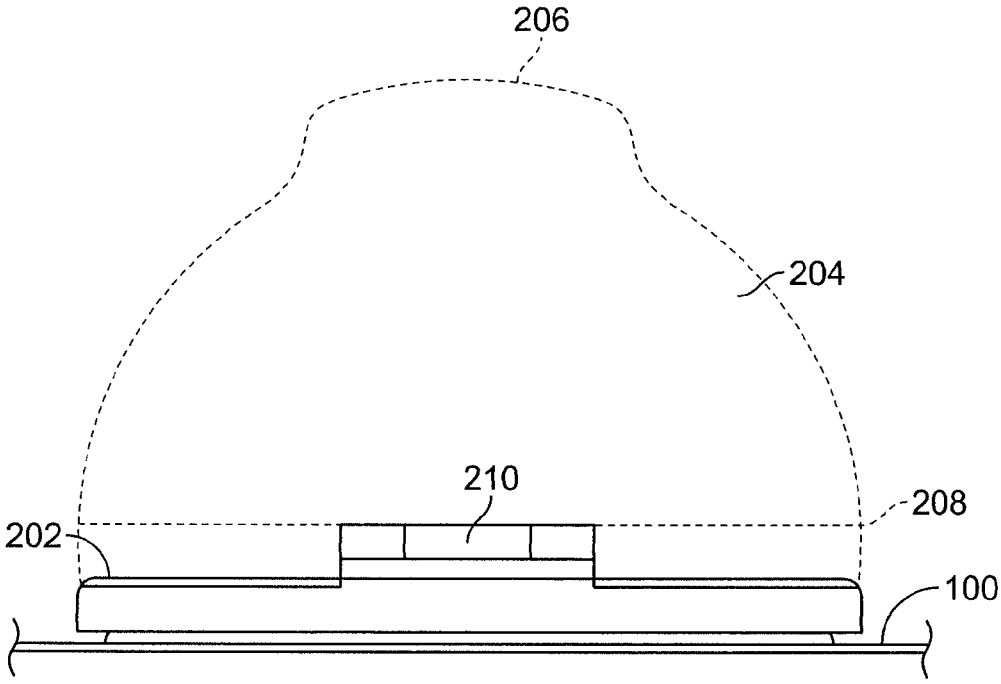
FIG. 9 is a cross-sectional view taken at 90 degrees to FIG. 8 showing the handle in the opening position.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The present invention is directed to a novel and unobvious can end 10 for sealing a beverage under pressure within a container (not shown). The can end 10 features an improved sealing arrangement heretofore not contemplated in the field of beverage packaging. Attempts to provide can ends having some, not all, of the benefits provided by the present invention have been at least commercially unsuccessful.

This can end 10 of the present invention provides many advantages over can ends in the prior art. For example, the can end 10 provides a mixed material sealing closure for seaming to a can body wherein weight percent of metal or metal alloys may be reduced. It further provides a safely ventable closure which allows a fluid pressure within the sealed container to be safely vented or exhausted without causing the closure member to be forcefully ejected from the can end. Furthermore, the can end 10 is resealable. This allows the contents of the container to be resealed within the container for future enjoyment while maintaining the freshness and taste of the beverage therein. The present invention provides many other advantages that would be readily understood by one of ordinary skill in the art of beverage container manufacture and use.

Turning to the figures, FIGS. 1-9 are various illustrations of the can end 10 and can end components of the present invention. Most generally, the can end 10 is positioned about a longitudinal axis 50 and includes a main portion, such as a lid 100, and a closure cap 200. The lid 100 is preferably produced from a metal or metal alloy, such as an aluminum alloy or steel. The closure cap 200 is preferably produce from a polymeric material which may be extremely rigid or, alternatively, pliable and elastically deformable.

The lid 100 includes some features which have become standard in the beverage can industry. The lid 100 generally includes a curl 112 defining an outer perimeter of the can end 10. A chuckwall 114 extends downwardly from a radially inner portion of the curl 114. In addition to extending downwardly, the chuckwall 114 may be angle radially inwardly relative to the longitudinal axis 50. It may include steps, an arcuate shape in cross-section, and any number of beads or forming techniques known to improve seaming and/or provide overall strength to the can end 10.

A means for providing strength to the can end 10 is integral with the chuckwall 114. This means for strengthening may be a typical countersink 116 as shown in the drawings or a fold as described in many commonly owned publications, including U.S. Pat. No. 7,174,762.

One or more panel radiuses join the countersink 116 to a center panel 118. The center panel 118 may be flat or domed shaped, but preferably includes a circumferential frustoconical portion 120 angling upwardly and radially inwardly relative to the longitudinal axis 50. This frustoconical portion terminates at an annular concave bend which directs the center panel further upwardly to an annular convex bend which directs the center panel 118 back downwardly and radially inwardly to a small curl 124 at least partially defining a dispensing aperture 122 positioned about the longitudinal axis 50. The purpose of the partial definition of the aperture 122 by the small curl 124 will be clear upon further description.

A plurality of circumferentially spaced projections, preferably three lugs 126, are located within the aperture 122. These lugs 126 may be part of the cap 200 or may be included on a separate sleeve, but are most preferably formed of the center panel 118 material and project radially inwardly into the aperture 122 from the perimeter of the aperture 122. A method of forming the lugs 126 is illustrated in the progression shown in FIG. 10. As illustrated in the final stage of the progression and in FIG. 1, the lugs 126 are most preferably integrally formed with portions of the small curl 124 such that in three locations equally spaced about the aperture 122, the three lugs 126 are formed along three, equally spaced, short lengths of the small curl 124. This is best illustrated in the progression illustrated in FIG. 10 in conjunction with the curl 124/lug 126 combination illustrated on the left side of the aperture 122 in FIG. 1. It is in this way that the small curl 124 preferably only partially defines the aperture 122, while along the three short lengths of the curl 124, the three lugs 126 contribute to the definition of the aperture 122.

Figure 10:
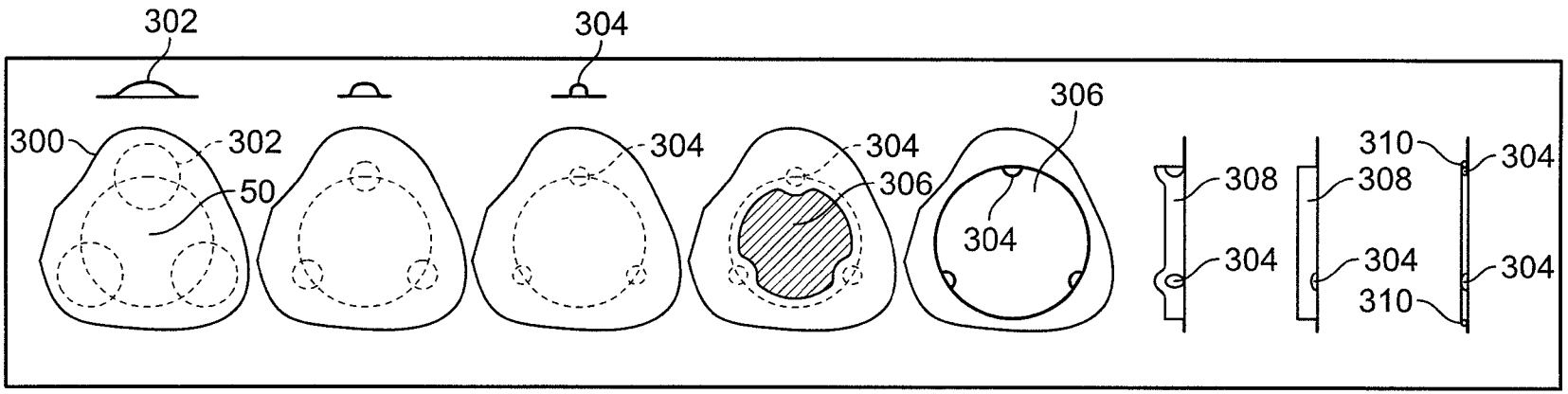
FIG. 10 is a series of illustration showing formation of lugs in a center panel segment of a can end.

Referring briefly to FIG. 10, a method for forming the lugs 126 is illustrated. The method progresses from left to right, and it begins with providing a blank 300. The blank 300 may be a flat sheet or a can end shell preformed in a configuration similar to that described above with a curl, a countersink, and a center panel. In a first step, a plurality of convex bubbles 302, preferably three equally spaced about the longitudinal axis 50, are formed extending outwardly/upwardly on an upper surface of the blank 300. In two subsequent steps, a diameter of each bubble 302 is decreased. This forms lugs 304 from the bubbles 302 and strengthens the material in that area. Next, an aperture 306 is punched in the blank 300 such that a flange 308 is formed. The flange 308 extends downwardly into the aperture 306. The lugs 304 are positioned so that they are adjacent an upper portion of the aperture 306. The flange 308 is then shortened to flatten the lugs 304. Finally, the remaining portion of the flange 308 is rolled to create a curl 310 (the small curl 124).

The closure cap 200 is located about the longitudinal axis 50 and in the aperture 122 to seal the can end 10 against a pressurized contents of the beverage container. Accordingly, the features of the cap 200 in combination with the features of the lid 100 form the sealing arrangement which makes up an aspect of the present invention. This cap 200 is preferably a separable but resealable closure as will be explained in more detail below.

The cap 200 includes an upper part and a lower part. The upper part lies predominately above the aperture 122. The lower part lies predominately within and below the aperture 122 within a containment space of the sealed beverage container.

The upper part of the cap 200 includes an upper surface 202. A handle 204 is joined to the upper surface of the cap 200. The handle 204 is preferably displaceable from a stowage position adjacent the upper surface 202 to an opening position. (See FIGS. 8 and 9). Accordingly, the handle 204 includes a lift end 206 and an opposing end 208. In the stowage position, the lift end 206 lies adjacent the upper surface 202, and preferably just beyond an outer perimeter of the cap 200 for ease of access. The lift end 206 is liftable wherein an angle between the lift end 206 and the longitudinal axis 50 is decreased, preferably to 0 degrees or very close thereto. The opposing end 208 of the handle 204 is hingedly connected to the upper surface 202 of the cap 200 so that the handle 204 pivots about the hinge connection. The opposing end 208 includes an outwardly projecting tab 210 to engage a portion of the cap and retain the handle 204 in the opening position if desired. The tab 210 preferably extends beyond the hinge connection and rotates with the handle 204 as the handle 204 is pivoted on the hinge connection. Preferably, the upper surface 202 of the cap 200 includes a locking groove or recess 212 adapted, as in sized and located, to receive the tab 210 therein and retain the handle 204 in the opening position. (See FIG. 7). The handle 204 has an elastic characteristic which allows it to be lifted from and returned to the stowage position multiple times while remaining hingedly joined to a portion of the can end 10, preferably the upper surface 202 of the cap 200.

The upper part of the cap 200 further includes a flange portion 214 which extends radially outwardly beyond the perimeter of the aperture 122. The flange 214 has a bottom surface 216 which includes an annular sealing ring for creating a pressure resistant seal with a portion of the center panel 118. The annular sealing ring preferably includes circumferential recess 218 into which a circumferential sealing liner 220 may be inserted. This sealing liner 220 is of a different polymeric material than the remaining portions of the cap 200. The annular sealing ring preferably engages the small curl 124 about the aperture 122 and, with force, seals against the curl 124 to form a pressure resistant seal with the center panel 118.

The lower part of the cap 200 includes a downwardly extending arcuate wall 222. This arcuate wall 222 may not be a continuous wall per se, but rather, it may have interruptions or gaps such that the overall arcuate wall 222 actually comprises a plurality of segments, preferably three. The arcuate wall 222 is located radially inwardly from the flange 214 and at least partially within the aperture 122. This wall 222 includes a plurality of channels 224 each having an entry/exit end 226 and a closed terminal end 228, which is generally elevated above the entry end 226. The lugs 126 are received into the channels 224 during closing/sealing and traverse within the channels during opening and closing of the can end 10. The entry/exit end 226 is open to receive a lug 126 therein, while the terminal end 228 includes an abutment to stop over travel by the lug 126 in the channel 224.

Each channel 224 includes an angled portion 230 between the entry end 226 and the terminal end 228. The angled portion 230 represents a vent region. The vent region is sloped downwardly relative to a lower surface 232 of the upper part of the cap 200. This vent region includes a vent stop 234 at the lowermost portion of the vent region, preferably adjacent the entry end 226. This vent stop 234 is created by a recess in the channel 224 where the channel 224, which is otherwise generally uniform in width, becomes wider due to the recess at the vent stop 234. With this arrangement, the terminal end 228 is located at a height above at least a portion of the entry end 226, and at least a segment of the entry end 226 is located a height above the vent stop 234.

The vent stop 234 is bounded by a pair of elevated portions of the channel 224. One of the elevated portions is formed by the gently downward slope of the channel 224 to the vent stop 234. The other is a lip 236 which angles back upwardly from the vent stop 234 to restore the width of the channel 224 to at least substantially the width in the terminal portion 228 of the channel 224 and which forms a portion of the open entry end 226.

As set forth above, the lip 236 is angled upwardly from the recess. This angle is generally greater than 0 degrees and less than 90 degrees, preferably 0 degrees to less than or equal to 80 degrees, more preferably greater than 0 degrees and less than or equal to 70 degrees, and most preferably greater or equal to 20 degrees and less than or equal to 60 degrees, or any angle or range of angles therein.

In a sealed condition, the lugs 126 are located in the channels 224 at the terminal end 228 against the abutment. The annular sealing ring is drawn against the small curl 124. The lugs 126 fit snuggly in the width of the channels 224 so that vertical movement along the longitudinal axis 50 is prevented, and the pressurized container remains sealed. Relative movement between the cap 200 and aperture 122, preferably caused by counterclockwise rotation of the cap 200, causes the lugs 126 to traverse within the channels towards the entry end 226. The slope of the channels 224 on the vent region causes the cap 200 to be unsealed against the center panel 118. The change in pressure causes the cap 200 to be forced swiftly but briefly outwardly along the longitudinal axis 50. This forces the lugs 126 into the vent stop 234 until the pressure from the container is expelled. As the pressure from the container is being released, the combination of the vent stop 234 and the lip 236 prevent the cap 200 from being forcefully ejected from the aperture 122. To remove the cap 200 fully, the user continues to turn the cap 200 counterclockwise, the lugs 126 travel upwardly against the upward slope of the lip 236 until the lugs 126 are aligned with the entry/exit end 226. Another small counterclockwise rotation of the cap 200 frees the lugs 126 from the channels 224 to interruptions in the arcuate wall 222. The lugs 126 may pass within the interruptions to fully remove the cap 200 from the lid 100. By reversing this process, the cap 200 may be resealed against the lid 100.

One of ordinary skill in the art would appreciate that the terms "first," "second," "upper," "lower," etc. are used for illustrative purposes only and are not intended to limit the embodiments in any way. The term "plurality" as used herein is intended to indicate any number greater than one, either disjunctively or conjunctively as necessary, up to an infinite number. The terms "joined," "attached," and/or "connected" as used herein are intended to put or bring two elements together so as to form a unit, and any number of elements, devices, fasteners, etc. may be provided between the joined, attached or connected elements unless otherwise specified by the use of the term "directly" and/or supported by the drawings. The term "annular" is used throughout the Specification to indicate a ring-like construction, and like many rings, the elements modified by the term "annular" are generally circumferential, but may have gaps, overlapping ends, unjoined ends, etc. that would improve the performance of the element in any way, especially in dimensional fit, strength, etc.

While the specific embodiments have been illustrated and described, numerous modifications come to mind without significantly departing from the spirit of the invention, and the scope of protection is only limited by the scope of the accompanying Claims.

What is claimed is:

1. A can end for a container, the can end comprising:

a metallic main portion positioned about a longitudinal axis comprising a curl defining a radially outer perimeter of the can end, a center panel joined to said curl, a dispensing aperture in said center panel, a plurality of projections extending radially inwardly into said dispensing aperture, and a second curl in said center panel defining a peripheral edge of said aperture; and a polymeric separable cap in said dispensing aperture comprising a plurality of angled channels, the channels comprising an entry portion opposite a terminal end and a vent region therebetween comprising a vent stop in said vent region wherein a width of said channels in said terminal end is less than a width of said channels at said vent stop, the polymeric cap further comprising a flange extending radially outwardly beyond a perimeter of said aperture, an arcuate lower wall extending downwardly relative to a lower surface of said separable cap, said arcuate lower wall located radially inwardly from said flange and at least partially located within said aperture, said flange in engagement with said second curl.

2. The can end of claim 1 wherein a lowermost portion of said channels defines said vent stop in said vent region.

3. The can end of claim 2 wherein the at least one of said angled channels channel further comprises:

a pair of elevated portions on opposite ends of said vent stop.

4. The can end of claim 2 wherein said vent stop comprises:

a recessed portion in said channels and a lip creating an angle with said recessed portion less than 90 degrees and greater than 0 degrees.

5. The can end of claim 1 wherein said vent region is located at a height below said terminal end and at least a segment of said entry portion is located at a height above said vent region.

6. A can end for a container, the can end comprising:

a metallic main portion positioned about a longitudinal axis comprising a curl defining a radially outer perimeter of the can end, a center panel joined to said curl, a dispensing aperture in said center panel, and a plurality of projections extending radially inwardly into said dispensing aperture;

a polymeric separable cap in said dispensing aperture comprising a plurality of angled channels, the channels comprising an entry portion opposite a terminal end and a vent region therebetween; and a displaceable handle having a lift end liftable from a stowage position to an opening position wherein an angle between said lift end and said longitudinal axis is decreased, said handle having an elastic characteristic wherein said handle can be lifted from and returned to said stowage position multiple times while remaining joined to a portion of the can end.

7. The can end of claim 6 wherein said opposing end of said displaceable handle is hingedly connected to said separable cap and has an outwardly extending tab which engages a portion a portion of said separable cap in said opening position to retain said displaceable handle in said opening position.

8. The can end of claim 7 further comprising:

a recess on a surface of said separable cap for receiving said tab therein when in said opening position and retaining said tab therein to maintain said displaceable handle in said opening position.

9. The can end of claim 1 further comprising:

an annular sealing ring positioned about said longitudinal axis on a bottom surface of said flange in engagement with said second curl to form a pressure resistant seal with said center panel.

10. The can end of claim 9 wherein said annular sealing ring comprises:

an annular recess in said bottom surface of said flange; and a seal liner within said annular recess of a different material than said separable cap.

11. The can end of claim 10 wherein said plurality of channels are located on said arcuate wall of said separable cap.

12. The can end of claim 1 wherein the metallic main portion further comprises:

a chuckwall extending downwardly from a radially innermost portion of the curl;

an annular strengthening means joining the chuckwall to said center panel; and a frustoconical portion on said center panel angling upwardly and radially inwardly wherein said dispensing aperture is at a greater height than a radially outer peripheral edge of said center panel.

13. A ventable sealing arrangement for safely releasing pressure within a beverage container under pressure upon opening of the beverage container, the ventable sealing arrangement comprising:

an aperture positioned about a longitudinal axis within which a resealable cap is located in a sealed condition;

a plurality of circumferentially spaced projections within said aperture; and a plurality of angled channels within said aperture and associated with each of said plurality of spaced projections wherein said spaced projections are located within corresponding angled channels, at least one of said plurality of angled channels having a vent stop, said vent stop characterized by a recessed portion in said channel and a lip creating an angle with said recessed portion less than 90 degrees and greater than 0 degrees wherein said angled channels extend downwardly to said vent stop and wherein said lip angles upwardly from said vent stop to an exit end of each of said angled channels.

14. The ventable sealing arrangement of claim 13 wherein said angle between said recessed portion and said lip is greater than 0 degrees and less than or equal to 80 degrees.

15. The ventable sealing arrangement of claim 13 wherein said angle between said recessed portion and said lip is greater than 0 degrees and less than or equal to 70 degrees.

16. The ventable sealing arrangement of claim 13 wherein said angle between said recessed portion and said lip is greater or equal to 20 degrees and less than or equal to 60 degrees.

17. The ventable sealing arrangement of claim 13 further comprising:

a lid having a main portion having a curl defining a radially outer perimeter of said lid, a center panel joined to said curl, and said aperture located on said center panel, and said plurality of circumferentially space projections extending radially inwardly into said aperture;

a separable cap in said dispensing aperture, said plurality of angled channels located on a downwardly extending wall of said separable cap and having an entry portion and a terminal portion, said vent stop located adjacent said entry portion; and wherein relative rotational movement of said separable cap within said aperture results in each of said plurality of spaced projections approaching said entry portion of each of said channels and into an associated vent stop recessed within said associated channel.

18. The ventable sealing arrangement of claim 13 further comprising:

a can lid having a curl defining a radially outer perimeter of said can lid, a center panel joined to said curl, a dispensing aperture in said center panel, wherein said plurality of projections extend radially inwardly into said dispensing aperture; and a separable cap in said dispensing aperture comprising said plurality of angled channels, said channels having an entry portion opposite a terminal end and a vent region including said vent stop therebetween wherein at least a segment of said entry portion is located at a height above said vent region.

19. The ventable sealing arrangement of claim 13 wherein at least one angled channel comprises an entry portion opposite a terminal portion and wherein said terminal portion is elevated above said entry portion.

20. A can end for a container, the can end comprising:

a metallic main portion positioned about a longitudinal axis comprising a first curl defining a radially outer perimeter of the can end, a center panel joined to said curl, a dispensing aperture in said center panel, and a second curl in said center panel defining a peripheral edge of said aperture including a plurality of projections extending radially inwardly into said dispensing aperture; and a polymeric separable cap in said dispensing aperture comprising a plurality of angled channels, the channels comprising an entry portion opposite a terminal end and a vent region therebetween comprising a vent stop in said vent region, the polymeric cap further comprising a flange extending radially outwardly beyond a perimeter of said aperture, an arcuate lower wall extending downwardly relative to a lower surface of said separable cap, said arcuate lower wall located radially inwardly from said flange and at least partially located within said aperture, said flange in sealing engagement with said second curl.

* * * * *